US012317942B1

(12) United States Patent
Pimentel De Oliveira et al.

(10) Patent No.: US 12,317,942 B1
(45) Date of Patent: Jun. 3, 2025

(54) POLYURETHANE GLOVE

(71) Applicant: Ansell Limited, Richmond (AU)

(72) Inventors: Geraldo Alexandre Pimentel De Oliveira, Coimbra (PT); Norazilayati Binti Rastam, Selangor (MY); Ahmad Helmi Bin Ujar, Selangor (MY); Wan Ashruzi Bin Wan Ahmad, Selangor (MY); Kamal Rusdi Bin Hashim, Perak (MY); Muhammad Shahrul Bin Jasmi, Selangor (MY)

(73) Assignee: Ansell Limited, Victoria (AU)

( * ) Notice: Subject to any disclaimer, the term of this patent is extended or adjusted under 35 U.S.C. 154(b) by 0 days.

(21) Appl. No.: 18/934,994

(22) Filed: Nov. 1, 2024

Related U.S. Application Data

(60) Provisional application No. 63/617,568, filed on Jan. 4, 2024.

(51) Int. Cl.
*A41D 19/00* (2006.01)

(52) U.S. Cl.
CPC ..... *A41D 19/0024* (2013.01)

(58) Field of Classification Search
CPC ..... A41D 19/055
See application file for complete search history.

(56) References Cited

U.S. PATENT DOCUMENTS

| | | | | |
|---|---|---|---|---|
| 11,390,743 | B2 | 7/2022 | Khoo | |
| 2002/0029402 | A1* | 3/2002 | Yeh | A61L 31/10 2/167 |
| 2004/0123374 | A1* | 7/2004 | Soerens | A41D 19/0058 2/161.6 |
| 2006/0068138 | A1* | 3/2006 | Janssen | A41D 19/0055 428/143 |
| 2020/0087510 | A1* | 3/2020 | Khoo | C08K 5/13 |
| 2020/0399450 | A1 | 12/2020 | Khoo | |
| 2022/0025161 | A1 | 1/2022 | Muthusamy et al. | |

FOREIGN PATENT DOCUMENTS

| | | | |
|---|---|---|---|
| CN | 107226897 | * | 10/2017 |
| CN | 107226897 | A | 10/2017 |
| CN | 107383312 | A | 11/2017 |
| CN | 115260443 | A | 11/2022 |
| WO | WO 00-25840 | A1 | 5/2000 |
| WO | WO 2004-016121 | A1 | 2/2004 |
| WO | WO 2004-060179 | A1 | 7/2004 |
| WO | WO 2008-036905 | A2 | 3/2008 |

OTHER PUBLICATIONS

Translation of CN 107226897 (Year: 2017).*
International Search Report and Written Opinion for application No. PCT/AU2024/051408 dated Apr. 13, 2025, 9 pgs.

* cited by examiner

*Primary Examiner* — Robert C Boyle
(74) *Attorney, Agent, or Firm* — Moser Taboada

(57) ABSTRACT

A polymeric glove is disclosed, which includes one or more polymer layers covering a user's fingers and palm, wherein at least one of the polymer layers comprises a polyurethane elastomer. A method to produce the polymeric glove is also disclosed.

20 Claims, 2 Drawing Sheets

POLYURETHANE GLOVE

FIELD

The instant disclosure is generally directed to protective articles and, more particularly, to protective articles such as a glove and/or other wearable articles that include protective polymeric layer(s), at least a portion of which is biodegradable.

BACKGROUND

Protective articles, such as gloves, sleeves, and the like, which are worn in industrial and/or household settings, have polymeric barriers disposed thereon. However, such articles do not typically include materials which are biodegradable.

Gloves and other protective equipment are required in most industrial settings. Demand for polymeric gloves and other protective equipment continues to rise. There is a need to improve the biodegradability of such articles to reduce the amount of non-biodegradable waste generated.

With the foregoing in view, the inventors have invented polymeric gloves which include a biodegradable material with improved properties relative to polymeric gloves currently known in the art, thereby improving both the performance of the polymeric gloves and reducing the amount of non-biodegradable landfill waste generated.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter. In embodiments, a polymeric glove comprises one or more polymer layers covering a user's fingers and palm, comprising a polyurethane elastomer.

Embodiments further include methods for manufacturing such gloves. The embodiments are substantially as shown in and/or described in connection with at least one of the figures, as set forth more completely in the claims. Various advantages, aspects and novel features of the present disclosure, as well as details of an illustrated embodiment thereof, will be more fully understood from the following description and drawings.

DESCRIPTION OF THE DRAWINGS

So that the manner in which the above recited features of embodiments of the instant disclosure can be understood in detail, a more particular description of the embodiments, briefly summarized above, may be had by reference to embodiments, some of which are illustrated in the appended drawings. It is to be noted, however, that the appended drawings illustrate only illustrative embodiments of this disclosure and are therefore not to be considered limiting of its scope, for the invention disclosed herein may admit to other equally effective embodiments.

DETAILED DESCRIPTION

Figure 1:
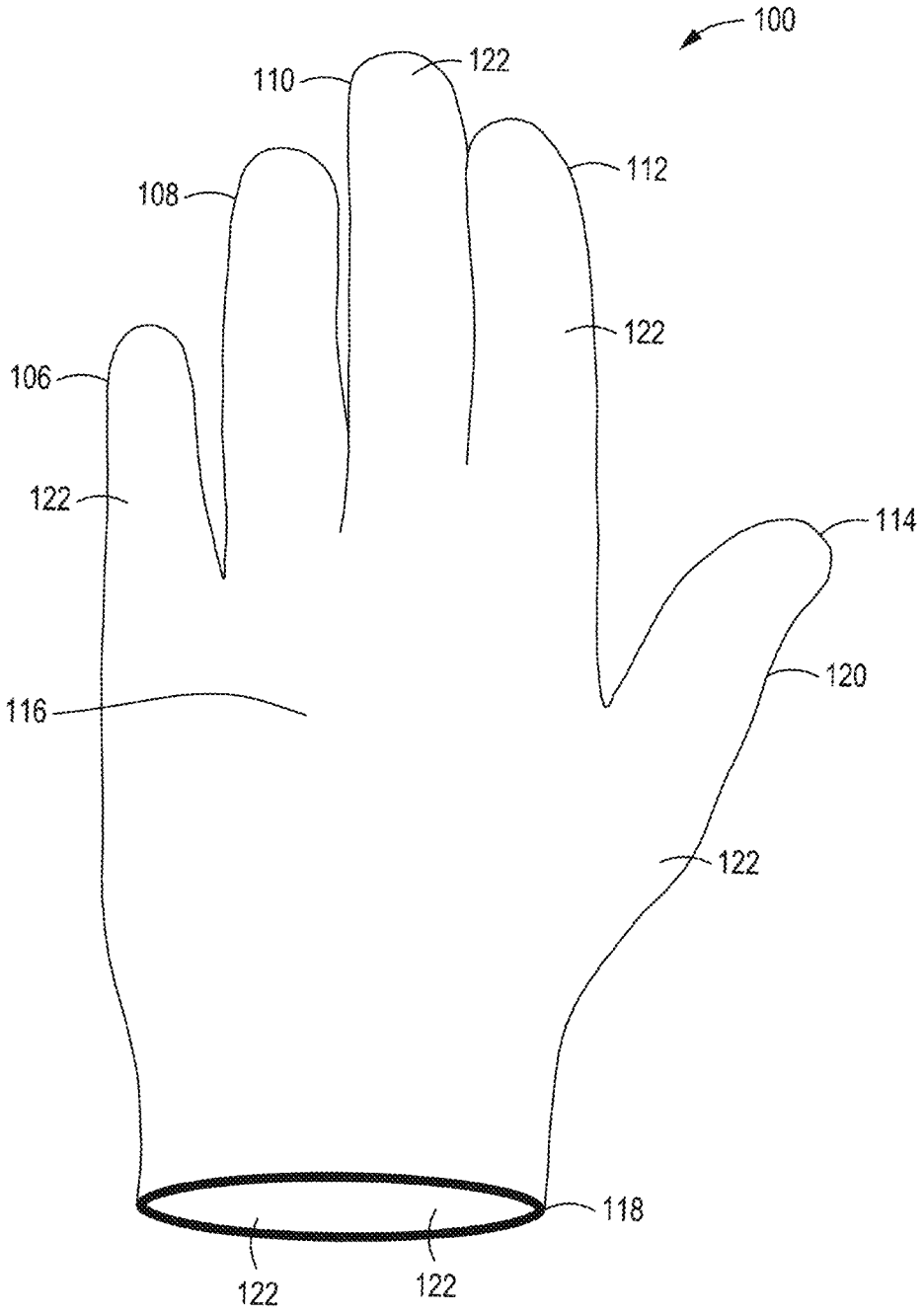
FIG. 1 depicts a polymeric glove according to embodiments disclosed herein.

At the outset, it should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary and this detailed description, each numerical value should be read once as modified by the term "about" (unless already expressly so modified), and then read again as not so modified unless otherwise indicated in context. Likewise, each limitation of an embodiment should be read once as comprising that embodiment, then again as consisting essentially of that embodiment, then again as consisting of that embodiment, unless otherwise indicated. For brevity, the term comprising is used throughout unless otherwise indicated.

For purposes herein, unless specified otherwise, a glove or other article has a degradation of greater than or equal to about 90% in less than 180 days when determined according to ISO 14855 under the composting condition.

In embodiments, a polymeric glove, also referred to herein simply as the "glove", comprises one or more polymer layers covering a user's fingers and palm, at least one of the polymer layers or the polymer layer comprising a polyurethane elastomer, wherein the polymeric glove has a degradation of greater than or equal to about 90% in less than 180 days when determined according to ISO 14855 under composting condition.

In embodiments, the polymeric glove comprises a biodegradable polyurethane elastomer comprising a polyester-polyurethane elastomer. In embodiments, the polymeric glove has a thickness from about 0.035 mm to 0.4 mm, when determined in a palm portion of the polymeric glove. In embodiments, one or more of the polymer layers further comprises an antioxidant, a curing agent, a pigment, a surfactant, a pH stabilizer, or a combination thereof.

In embodiments, the curing agent, i.e., crosslinking agent or system, comprises a metal oxide which does not comprise zinc, i.e., a non-zinc metal oxide. In embodiments, the polymeric formulation is free from accelerators, sulfur, and zinc. Instead, a metal oxide based crosslinking agent is used, which is believed to contribute to the breathability of the resultant layer, as demonstrated by the polymeric glove having a moisture vapor transmission rate of greater than or equal to about 900 $g/d \cdot m^2$ when determined according to EN 13726-2. In addition, the polymeric glove provides an unexpected improvement in chemical resistance to sodium hydroxide and other materials. Without wishing to be bound by theory, this is thought to result from the clean formulation obtained by excluding zinc compounds and sulfur. The inventors have further observed that the polymeric glove according to embodiments disclosed herein, has an unexpected lowering of swell when in contact with various chemicals, thereby providing an improvement in food handling.

In embodiments, the polymeric glove has a normalized breakthrough time (NBT) of greater than or equal to about 480 minutes for 40% sodium hydroxide. As such, in embodiments, the polymer glove has a chemical resistance level L6 for 40% sodium hydroxide.

In embodiments, the polymeric glove has a food migration value of less than or equal to about 3 $mg/dm^2$ for acetic acid, and less than or equal to about 1.7 $mg/dm^2$ for ethanol when determined according to BS EN1186, or an equivalent thereof. Accordingly, embodiments of the polymeric glove have a food migration value of less than 10 mg/dm$^2$, rendering the polymeric glove suitable for use in food handling applications.

In embodiments, the polymeric glove is free (i.e., comprises less than or equal to about 0.01 wt %) of an activator, a curing accelerator, a curing agent, or a combination thereof. In embodiments, the polymeric glove is free of trivalent metal oxides. In embodiments, the polymeric glove is free of zinc. In embodiments, the polymeric glove is free of sulfur. In embodiments, the polymeric glove is free of trivalent metal oxides. In embodiments, the polymeric glove is free of zinc and sulfur.

In embodiments, the polymeric glove has a moisture vapor transmission rate of greater than or equal to about 900 g/d·m$^2$ (grams per day per square meter), when determined according to EN 13726-2. In embodiments, the polymeric glove has a moisture vapor transmission rate of greater than or equal to about 950 g/d·m$^2$, or greater than or equal to about 980 g/d·m$^2$, or greater than or equal to about 1000 g/d·m$^2$, or greater than or equal to about 1100 g/d·m$^2$, and less than or equal to about 5000 g/d·m$^2$), when determined according to EN 13726-2. Accordingly, the polymeric glove possesses superior properties to nitrile-butadiene gloves, which typically have a moisture vapor transmission rate of about 250 g/d·m$^2$, when determined according to EN 13726-2.

In embodiments, the polymeric glove has an ultimate tensile strength of greater than or equal to about 22 MPa, when determined according to ASTM D412. In embodiments, the polymeric glove has an ultimate tensile strength of greater than or equal to about 23 MPa, or greater than or equal to about 24.5 MPa, or greater than or equal to about 25.1 MPa, or greater than or equal to about 26 MPa, or greater than or equal to about 27 MPa, or greater than or equal to about 27.5 MPa, and less than or equal to about 30 MPa when determined according to ASTM D412.

In embodiments, the polymeric glove has a percent elongation at break of greater than or equal to about 750%, when determined according to ASTM D412. In embodiments, the polymeric glove has a percent elongation at break of greater than or equal to about 780%, or greater than or equal to about 790%, or greater than or equal to about 800%, or greater than or equal to about 820%, and less than or equal to about 950% when determined according to ASTM D412.

In embodiments, the polymeric glove has a modulus at 300% elongation (M300) from about 2.75 to 3.05 MPa, when determined according to ASTM D412. In embodiments, the polymeric glove has a modulus at 300% elongation (M300) of greater than or equal to about 2.8 MPa, or greater than or equal to about 2.9 MPa, or greater than or equal to about 2.95 MPa, and less than or equal to about 3 MPa, or less than or equal to about 3.05 MPa. when determined according to ASTM D412.

In embodiments, the polymeric glove has an EN Force at Break (FAB) of greater than or equal to about 6 N, or from about 6.1 N to about 7.8 N, when determined according to EN455-2. In embodiments, the polymeric glove has an EN FAB of greater than or equal to about 6.2 N, or greater than or equal to about 6.4 N, or greater than or equal to about 6.7 N, or greater than or equal to about 7 N, or greater than or equal to about 7.3 N, and less than or equal to about 7.7 N, or less than or equal to about 7.8 N, when determined according to EN455-2.

In embodiments, the polymeric glove is suitable for use as a surgical or industrial glove and has a Force at Break (FAB) of greater than or equal to about 9 N, or greater than or equal to about 9.5 N, or greater than or equal to about 10 N, when determined according to EN455-2. In embodiments, when evaluated using a fabric touch tester (FFT) e.g., SDL Atlas M293-FFT fabric touch tester, available from SDL-Atlas, South Carolina, USA, the polymeric glove according to embodiments disclosed herein has one or more improved somatosensory properties of smoothness, softness and warmness when evaluated using a fabric touch tester (FFT), i.e., an FFT smoothness value, an FFT softness value, and an FFT warmness value, when determined relative to comparative materials in the art. Somatosensory properties may be determined utilizing statistical analysis relative to bending average rigidness, bending work, compression work, compression recovery rate, compression average rigidity, surface friction coefficients, surface roughness, wave amplitude, wavelength, thermal conductivity, maximum thermal heat flux, and the like.

In embodiments, the polymeric glove consists of, or consists essentially of a single polymer layer. In embodiments, the polymeric glove further comprises one or more additional layers or blends thereof comprising polyisobutylene, polychloroprene, ethylene vinyl acetate, ethylene methyl acrylate, ethylene-propylene rubber, ethylene-propylene diene rubber, natural rubber, polyisoprene, polyurethane, nitrile-butadiene rubber, carboxylated nitrile-butadiene rubber, polyamide, styrene-butadiene rubber polyvinyl chloride, acrylic, polyvinyl acetate, chlorosulphonated polyethylene rubber, isobutylene-isoprene rubber, or a combination thereof.

In some embodiments, the polymeric glove further comprises a skin-contacting coating layer comprising polyisobutylene, polychloroprene, ethylene vinyl acetate, ethylene methyl acrylate, ethylene-propylene rubber, ethylene-propylene diene rubber, natural rubber, polyisoprene, polyurethane, nitrile-butadiene rubber, carboxylated nitrile-butadiene rubber, polyamide polyvinyl chloride, acrylic, polyvinyl acetate, chlorosulphonated polyethylene rubber, isobutylene-isoprene rubber, or in embodiments, the skin-contacting layer comprises styrene-butadiene rubber, ethylene methyl acrylate, ethylene-propylene rubber, ethylene-propylene diene rubber, nitrile-butadiene rubber, carboxylated nitrile-butadiene rubber, or a combination thereof. In some embodiments, the polymeric glove is formed from a single layer comprising the polyurethane elastomer, and an inner coating layer having a thickness of less than or equal to about 20% of a thickness of the single layer comprising the polyurethane elastomer. In embodiments, the skin contacting coating layer has a thickness from about 0.0005 mm to less than or equal to about 0.01 mm.

In embodiments, the polymeric glove is formed from an emulsion comprising the polyurethane elastomer, which in embodiments comprises a polyester-polyurethane elastomer, which in embodiments comprises a biodegradable polyurethane elastomer, and/or which in embodiments comprises a biodegradable polyester-polyurethane elastomer.

In embodiments, a method to produce a polymeric glove according to any one of the above embodiments comprises coating a glove former in an aqueous coagulant solution to produce a coagulant coated former; coating the coagulant coated former with an emulsion comprising a polyurethane elastomer; curing the emulsion comprising the polyurethane elastomer coated on the coagulant coated former to produce a polymer layer thereon; and obtaining a glove by removing the polymer layer from the former.

In embodiments, the polyurethane elastomer may further comprise polyester moieties, i.e., a polyester-polyurethane, containing ester functional groups in its backbone. In embodiments, the polymeric glove further comprises a pH stabilizer, a crosslinking agent, an antioxidant, a pigment, a filler, or a combination thereof. In embodiments, the polymeric glove may further include a filler, which may be an inorganic and/or an organic filler. In embodiments, inorganic fillers include calcite, carbonate or metal carbonate, such as calcium carbonate (or limestone), potassium carbonate, magnesium carbonate, aluminum carbonate, zinc carbonate, copper carbonate, chalk, dolomite, silicates, such as hydrous magnesium silicates, such as talc or soapstone, calcium silicate (wollastonite), potassium silicate, magnesium silicate (talc), aluminum silicate (kaolin), or mixtures thereof, such as mica, smectites such as montmorillonite, vermiculite and palygorskite-sepiolite, sulfates such as barium sulfate, or calcium sulfate (gypsum), mica, hydroxide salts or metal hydroxides such as calcium hydroxide or potassium hydroxide (potassium), or magnesium hydroxide or aluminum hydroxide or sodium hydroxide (caustic soda), hydrotalcite, metal oxides or oxide salts such as magnesium oxide or calcium oxide or aluminum oxide or iron oxide or selected from the group consisting of copper oxide, clay, asbestos, silica, graphite, carbon black, metal fibers or metal foils, glass fibers, magnetic fillers, aramid fibers, ceramic fibers and their derivatives or blends/mixtures of these materials but not limited to these.

Alternatively or additionally, in embodiments the filler comprises an organic filler, including wood flour, vegetable flour or vegetable flour such as cereal flour (e.g., corn flour, wheat flour, rice flour, soybean flour, nutshell flour, clamshell flour, corn cobs, cork flour, rice hulls, and/or the like, as well as sawdust, vegetable fibers, such as flax fibers, wood fibers, hemp fibers, bamboo fibers, palm fibers and derivatives thereof, or blends/mixtures of these materials. Other suitable fillers include lignin, polysaccharides such as cellulose or hemicellulose, starch, chitin, chitosan and derivatives or blends/mixtures of these materials.

In embodiments, one or more of the layers of the polymeric glove may comprise or consists essentially of, or consists of individual or blends of polyisobutylene, polychloroprene, ethylene vinyl acetate, ethylene methyl acrylate, ethylene-propylene rubber, ethylene-propylene diene rubber, natural rubber, polyisoprene, polyurethane, nitrile butadiene rubber (NBR), carboxylated nitrile butadiene rubber, styrene-butadiene rubber, polyamide, polyvinyl chloride, acrylic, polyvinyl acetate, chlorosulphonated polyethylene rubber, isobutylene-isoprene rubber, or blends and/or mixtures thereof. In embodiments, at least a portion of an external surface of the polymeric glove has a textured surface.

In embodiments the polymeric glove is formed from an emulsion, e.g., a latex emulsion, comprising the polyurethane elastomer, in combination with any additional fillers, pH stabilizers, surfactants, surfactant systems, solvents, curing agents, curing accelerators, and the like. In embodiments, the latex emulsion is an aqueous emulsion.

In embodiments, the latex emulsion is cured to form the polymer layer from which the polymeric glove is formed. Curing may be obtained via an activator, a curing accelerator, a curing agent, or a combination thereof.

In embodiments, the curing agent comprises a metal. In embodiments, the curing agent comprises, consists essentially, or consists of a metal oxide. In embodiments, the curing agent comprises, consists essentially, or consists of a trivalent metal curing agent.

In alternative embodiments, the polymeric glove is free of an activator, a curing accelerator, a curing agent, or a combination thereof, i.e., the glove comprises less than about 0.01 wt % of any activator, a curing accelerator, and/or a curing agent. In embodiments, the polymeric glove is free of any trivalent metals. In embodiments, the polymeric glove is free of zinc, i.e., zinc is not intentionally added to the composition from which the glove is formed, and the glove comprises less than about 0.01 wt % zinc. In embodiments, the polymeric glove is free of sulfur, i.e., sulfur is not intentionally added to the composition from which the glove is formed, and the glove comprises less than about 0.01 wt % sulfur.

In embodiments, a method to produce a glove according to any one or more of embodiments disclosed herein comprises coating a glove former in an aqueous coagulant solution to produce a coagulant coated former; coating the coagulant coated former with composition, which in embodiments is a latex emulsion, which in embodiments is an aqueous latex emulsion comprising a polyurethane elastomer; curing the aqueous emulsion coated on the coagulant coated former to produce a polymer layer thereon; and obtaining a glove according to any one or more embodiments disclosed herein by removing the polymer layer from the former. The method may further include coating the polyurethane elastomer layer with a skin-contacting layer prior to curing.

In embodiments of the method, the coating of the coagulant coated former to form a second layer, with the latex emulsion includes drying the latex emulsion on the coagulant coated former and coating the dried rubber coated on the coagulant coated former with a second layer of the same or a different latex emulsion.

In embodiments of the method, the coating the coagulant coated former with the latex emulsion includes drying the latex emulsion on the coagulant coated former and coating the dried rubber coated on the coagulant coated former with a second relatively thin (i.e., having a thickness of less than about 0.001 mm) skin contacting coating layer.

In embodiments, the skin contacting coating layer comprises styrene-butadiene rubber, ethylene methyl acrylate, ethylene-propylene rubber, ethylene-propylene diene rubber, nitrile-butadiene rubber, carboxylated nitrile-butadiene rubber, or a combination thereof. In embodiments, the skin contacting coating layer is applied by dipping. In other embodiments, the skin contacting coating layer is applied by spraying.

In some embodiments, the polymeric glove comprises a plurality of polymer layers. In other embodiments, the polymeric glove is formed from a single polymer layer, which in embodiments is a blend.

In embodiments, the polymeric gloves have a thickness from about 0.035 mm to 0.4 mm. In embodiments, the polymeric gloves have a thickness of greater than or equal to about 0.045 mm, or of greater than or equal to about 0.05 mm, or of greater than or equal to about 0.055 mm, or of greater than or equal to about 0.06 mm, and less than or equal to about 0.4 mm, or less than or equal to about 0.35 mm, or less than or equal to about 0.3 mm, or less than or equal to about 0.2 mm, or less than or equal to about 0.1 mm, when determined as an average over the portion of the glove covering the palm of the end user's hand. In embodiments, the polymeric glove is a non-supported single use glove, or a general purpose glove, or a surgical glove.

FIG. 1 depicts an unsupported polymeric glove 100 formed from a single polymer layer according to embodiments of the instant disclosure. Although shown as an unsupported glove, the embodiments disclosed herein equally apply to supported gloves as well. The polymeric glove 100 comprises a pinky finger 106, a ring finger 108, a middle finger 110, an index finger 112, a thumb 114, a palm component 116, and may optionally include a beaded cuff 118 as shown in FIG. 1. The unsupported polymeric glove 100 comprises at least one polymer layer 120.

The polymer layer 120 comprises a polyurethane elastomer. In other embodiments the polymer layer further comprises a blend of the biodegradable polyurethane elastomer with other different elastomers including polyisobutylene, polychloroprene, ethylene vinyl acetate, ethylene methyl acrylate, ethylene-propylene rubber, ethylene-propylene diene rubber, natural rubber, polyisoprene, polyurethane, nitrile-butadiene rubber, carboxylated nitrile-butadiene rubber, styrene-butadiene rubber polyamide, polyvinyl chloride, acrylic, polyvinyl acetate, chlorosulphonated polyethylene rubber, isobutylene-isoprene rubber, or a combination thereof.

Figure 2:
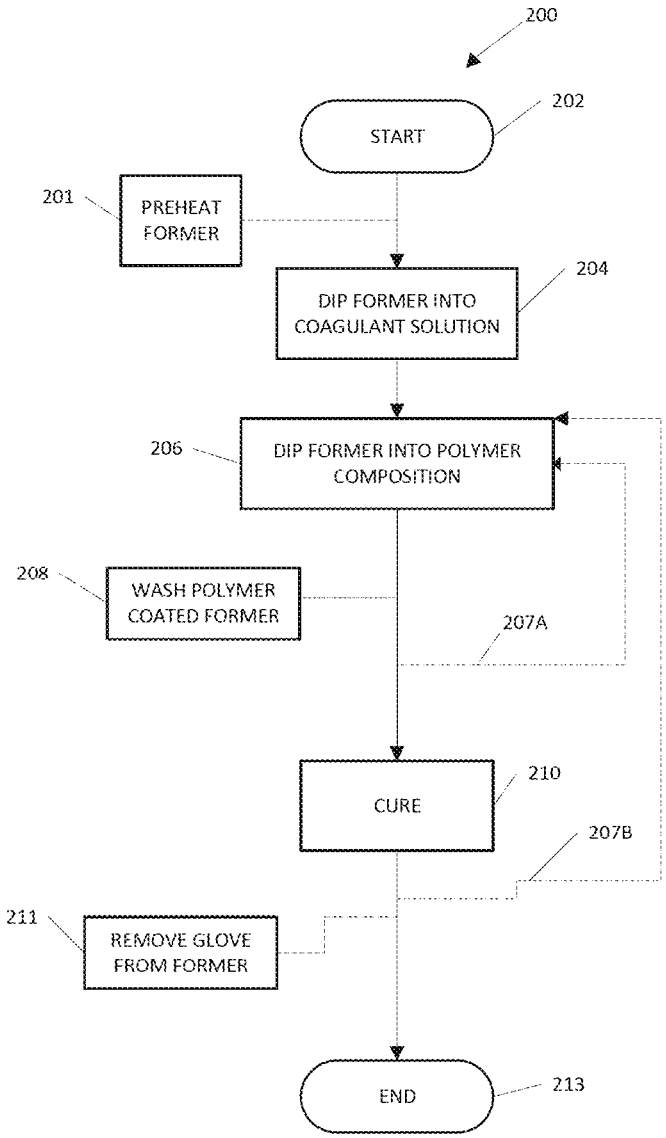
FIG. 2 depicts a method for forming a polymeric glove according to embodiments disclosed herein.

FIG. 2 depicts a method 200 for forming a glove comprising one or more polymer layers covering a user's fingers and palm wherein at least one of the polymer layers comprises a biodegradable polyurethane elastomer, e.g., comprising a polymer layer 120, according to embodiments of the instant disclosure. At block 202, the method 200 starts with the undressed hand shaped former. In some embodiments, the former is heated (block 201) before proceeding to block 204. At block 204, the former is coated with a coagulant, for example, by dipping the former into a bath of the coagulant solution. The coagulant solution may also be applied thereto, such as by spraying. The coagulant is then allowed to dry as coagulant particles on the former. In at least one embodiment, the coagulant solution is heated, e.g., at a temperature ranging from about 42° C. to 55° C. In some embodiments, excess coagulant solution is allowed to drip dry from the liner and/or the former.

At block 206, the undressed former is dipped into a polymeric or elastomeric composition according to embodiments disclosed herein, forming the polymer layer comprising a e polyurethane elastomer (the elastomer layer) thereon.

The dipping may be a palm dip, a ¾ dip, a knuckle dip or a full dip as is known to those in the art. The polymer layer may be allowed to drip down to reduce the thickness of the polymer layer formed thereon. In embodiments, the former having the polymer layer disposed thereon is rotated so that the polymer layer can dry in ambient air for several minutes. In at least one embodiment, the polymer layer is allowed to dry for approximately one hour.

In embodiments, the polymer coating may be leached or washed (block 208) using an aqueous solution or water at an appropriate temperature. The former may be washed prior to coating with the coagulant and or a release layer may be disposed on the former prior to disposition of the coagulant to facilitate removal of the polymeric glove from the former once formed.

At block 210, the polymer layer or layers undergoes curing to cure the polymer layer or layers. In embodiments, the polymer layer is cured, for example, at a temperature ranging between 60° C.-130° C. In some embodiments, the polymeric layer is cured at, for example, 70° C. to 120° C. from about 10 minutes to 1 hour. In embodiments, the curing block comprises curing in an oven, such as an infrared oven, and may further include a plurality of curing temperatures e.g., at, for example, 70° C. for approximately 10 to 20 minutes in a first curing stage, 100° C. for approximately 10 to 20 minutes, and at 130° C. for approximately 10 to 20 minutes, wherein a cured glove is formed.

In embodiments, the curing block 210 is conducted isothermally for a period of time. In other embodiments, the curing block 210 is conducted in a staged process at different temperatures for the same or different periods of time.

If the polymeric glove consists essentially of a single polymer layer, the polymer layer present on the former is then cured at 210. In embodiments in which the polymeric glove comprises a plurality of polymer layers or blends thereof, a portion of the method 200 is repeated. In embodiments, the polymer coated former may be again dipped or sprayed with another material to form a second or additional layer of a different material. In some embodiments, the polymer coated former is dipped a second time to form a skin-contacting coating layer comprising polyisobutylene, polychloroprene, ethylene vinyl acetate, ethylene methyl acrylate, ethylene-propylene rubber, ethylene-propylene diene rubber, natural rubber, polyisoprene, polyurethane, nitrile-butadiene rubber, carboxylated nitrile-butadiene rubber, polyamide polyvinyl chloride, acrylic, polyvinyl acetate, chlorosulphonated polyethylene rubber, isobutylene-isoprene rubber, or a combination thereof.

For example, a first polymer layer may be formed in block 206, followed by optionally washing 208, and then this portion of the method 200 may be repeated one or more times (indicated via 207A) beginning with the dipping block 206, wherein the coated former is again dipped into the same or a different polymer composition to form any number of subsequent polymer layer(s) thereon.

In embodiments, a first polymer layer may be formed in block 206, followed by optionally washing 208, and then the layer cured (block 210) and then this portion of the method 200 may be repeated one or more times (indicated via 207B) beginning with the dipping block 206, wherein the coated former is again dipped into the same or a different polymer composition or blends thereof to form any number of subsequent polymer layer(s) thereon which are cured (block 210).

At block 211 the polymeric glove is then removed from the former, which in embodiments is via inversion. In some embodiments, the method further includes beading the polymer layer to form a cuff prior to removing the disposable glove from the former. At block 213, the method 200 ends.

In embodiments, the method to produce the polymeric glove according to embodiments disclosed herein is conducted using an apparatus suitable for conducting the method, comprising one or more controllers, conveyors, formers, tanks, ovens, and the like. In embodiments, the former may be metallic or ceramic, and is generally in the shape of a hand. The former may be in an arcuate shape, such as a partially closed hand or, alternatively, a flat shape.

Also, some blocks of the preceding method may be omitted or performed in a different sequence. In embodiments, other processes may be applied before the curing. Furthermore, additional blocks may be employed. For example, the uncured polymer layer on the former may be stripped, washed, and dried after the curing. Washing can be carried out at a temperature between approximately 25° C. and 60° C., for approximately 15 to 90 minutes. The polymeric gloves may be dried in a tumble dryer e.g., for approximately 20 to 60 minutes at 50° C. to 70° C.

In embodiments, at least a portion of an external surface of the single use glove has a textured surface. In some embodiments, the texturization or wrinkling processes may comprise a salt-based texturization applied to polymer layer, as disclosed in commonly-assigned U.S. Pat. Nos. 8,522,363 and 7,771,644, each of which is incorporated by reference in its entirety. In other embodiments, the single use glove having a textured external surface may comprise a textured external layer disposed over a portion of the polymer layer to impart texture to the outer surface. In other embodiments, a portion of the former used to produce the single use glove includes one or more textured portions dimensioned and arranged to impart a textured surface on a portion of the single use glove formed using the textured former.

At least one exemplary embodiment according to this disclosure comprises a second polymeric layer. For example, the method for making a single use glove may further comprise disposing another polymer layer on the former described above. The polymer layer may optionally have a coagulant disposed thereon.

Embodiments

The instant disclosure includes, but is not limited to the following embodiments.

E1. A polymeric glove comprising:
- one or more polymer layers covering a user's fingers and palm,
- comprising a polyurethane elastomer,
- wherein the polymeric glove has a moisture vapor transmission rate of greater than or equal to about 900 $g/d \cdot m^2$ when determined according to EN 13726-2.

E2. The polymeric glove according to embodiment E1, wherein the polyurethane elastomer comprises a polyester-polyurethane elastomer.

E3. The polymeric glove according to any of embodiments E1-E2, wherein the polyurethane elastomer comprises a biodegradable polyurethane elastomer, and wherein the polymeric glove has a degradation of greater than or equal to about 90% in less than 180 days when determined according to ISO 14855 under composting condition.

E4. The polymeric glove according to Embodiment E3, wherein the biodegradable polyurethane elastomer comprises a polyester-polyurethane elastomer.

E5. The polymeric glove according to any of embodiments E1-E4, having a thickness from about 0.035 mm to 0.4 mm, when determined in a palm portion of the polymeric glove.

E6. The polymeric glove according to any of embodiments E1-E5, further comprising an antioxidant, a curing accelerator, a curing agent, a pigment, a surfactant, a pH stabilizer, or a combination thereof.

E7. The polymeric glove according to any of embodiments E1-E6, which is free of zinc.

E8. The polymeric glove according to any of embodiments E1-E7, which is free of sulfur.

E9. The polymeric glove according to any of embodiments E1-E8, having a moisture vapor transmission rate of greater than or equal to about 950 $g/d \cdot m^2$ when determined according to EN 13726-2.

E10. The polymeric glove according to any of embodiments E1-E9, having an ultimate tensile strength of greater than or equal to about 22 MPa, when determined according to ASTM D412.

E11. The polymeric glove according to any of embodiments E1-E10, having a percent elongation at break of greater than or equal to about 750%, when determined according to ASTM D412.

E12. The polymeric glove according to any of embodiments E1-E11, having a modulus at 300% elongation (M300) from about 2.75 to 3.05 MPa, when determined according to ASTM D412.

E13. The polymeric glove according to any of embodiments E1-E12, having a EN force at break of greater than or equal to about 9 N, when determined according to EN455-2.

E13.1 The polymeric glove according to any of embodiments E1-E12, having a EN force at break of greater than or equal to about 6 N, when determined according to EN455-2.

E14. The polymeric glove according to any of embodiments E1-E13, consisting essentially of a single polymer layer.

E15. The polymeric glove according to any of embodiments E1-E13, further comprising one or more additional layers comprising polyisobutylene, polychloroprene, ethylene vinyl acetate, ethylene methyl acrylate, ethylene-propylene rubber, ethylene-propylene diene rubber, natural rubber, polyisoprene, polyurethane, nitrile-butadiene rubber, carboxylated nitrile-butadiene rubber, polyamide polyvinyl chloride, acrylic, polyvinyl acetate, chlorosulphonated polyethylene rubber, isobutylene-isoprene rubber, or a blends thereof.

E16. The polymeric glove according to any of embodiments E1-E15, further comprising a skin-contacting coating layer comprising polyisobutylene, polychloroprene, ethylene vinyl acetate, ethylene methyl acrylate, ethylene-propylene rubber, ethylene-propylene diene rubber, natural rubber, polyisoprene, polyurethane, nitrile-butadiene rubber, carboxylated nitrile-butadiene rubber, polyamide polyvinyl chloride, acrylic, polyvinyl acetate, chlorosulphonated polyethylene rubber, isobutylene-isoprene rubber, or a combination thereof.

E17. The polymeric glove according to embodiment E16, wherein the skin contacting coating layer has a thickness from about 0.0005 mm to less than or equal to about 0.01 mm.

E18. The polymeric glove according to any of embodiments E1-E17, formed from an emulsion comprising the polyurethane elastomer.

E19. A method to produce a polymeric glove according to any of embodiments E1-E18, comprising:
- coating a glove former in an aqueous coagulant solution to produce a coagulant coated former;
- coating the coagulant coated former with an emulsion comprising a polyurethane elastomer,
- curing the emulsion comprising the polyurethane elastomer coated on the coagulant coated former to produce a polymer layer thereon; and
- obtaining the polymeric glove by removing the polymer layer from the former.

E20. A method to produce a polymeric glove, comprising:
- coating a glove former in an aqueous coagulant solution to produce a coagulant coated former;
- coating the coagulant coated former with an emulsion comprising a polyurethane elastomer,
- curing the emulsion comprising the polyurethane elastomer coated on the coagulant coated former to produce a polymer layer thereon; and
- obtaining the polymeric glove by removing the polymer layer from the former, wherein the polymeric glove comprises the polyurethane elastomer, and
- wherein the polymeric glove has a moisture vapor transmission rate of greater than or equal to about 900 $g/d \cdot m^2$ when determined according to EN 13726-2.

E21. The method according to embodiments E19-E20, wherein the polyurethane elastomer comprises a biodegradable polyurethane elastomer, and wherein the polymeric glove has a degradation of greater than or equal to about 90% in less than 180 days when determined according to ISO 14855 under a composting condition.

The foregoing disclosure and description of the invention is illustrative and explanatory thereof and it can be readily appreciated by those skilled in the art that various changes in the size, shape and materials, as well as in the details of the illustrated construction or combinations of the elements described herein can be made without departing from the spirit of the invention.

We claim:

1. A polymeric glove comprising:

one or more polymer layers covering a user's fingers and palm, comprising a polyurethane elastomer, a curing agent comprising a metal oxide;

wherein the polyurethane elastomer comprises a biodegradable polyurethane elastomer, and wherein the polymeric glove has a degradation of greater than or equal to about 90% in less than 180 days when determined according to ISO 14855 under composting condition; and wherein the polymeric glove is free of zinc, is free of sulfur, or is free of both zinc and sulfur.

2. The polymeric glove of claim 1, wherein the polyurethane elastomer comprises a polyester-polyurethane elastomer.

3. The polymeric glove of claim 1, wherein the biodegradable polyurethane elastomer comprises a polyester-polyurethane elastomer.

4. The polymeric glove of claim 1, having a thickness from about 0.035 mm to 0.4 mm, when determined in a palm portion of the polymeric glove.

5. The polymeric glove of claim 1, further comprising an antioxidant, a curing accelerator, a curing agent, a pigment, a surfactant, a pH stabilizer, or a combination thereof.

6. The polymeric glove of claim 1, having a moisture vapor transmission rate of greater than or equal to about 950 $g/d \cdot m^2$ when determined according to EN 13726-2.

7. The polymeric glove of claim 1, having an ultimate tensile strength of greater than or equal to about 22 MPa, when determined according to ASTM D412.

8. The polymeric glove of claim 1, having a percent elongation at break of greater than or equal to about 750%, when determined according to ASTM D412.

9. The polymeric glove of claim 1, having a modulus at 300% elongation (M300) from about 2.75 to 3.05 MPa, when determined according to ASTM D412.

10. The polymeric glove of claim 1, having a EN force at break of greater than or equal to about 6 N, when determined according to EN455-2.

11. The polymeric glove of claim 1, having a EN force at break of greater than or equal to about 9 N, when determined according to EN455-2.

12. The polymeric glove of claim 1, consisting essentially of a single polymer layer.

13. The polymeric glove of claim 1, further comprising one or more additional layers comprising polyisobutylene, polychloroprene, ethylene vinyl acetate, ethylene methyl acrylate, ethylene-propylene rubber, ethylene-propylene diene rubber, natural rubber, polyisoprene, polyurethane, nitrile-butadiene rubber, carboxylated nitrile-butadiene rubber, polyamide polyvinyl chloride, acrylic, polyvinyl acetate, chlorosulphonated polyethylene rubber, isobutylene-isoprene rubber, or a blends thereof.

14. The polymeric glove of claim 1, further comprising a skin-contacting coating layer comprising polyisobutylene, polychloroprene, ethylene vinyl acetate, ethylene methyl acrylate, ethylene-propylene rubber, ethylene-propylene diene rubber, natural rubber, polyisoprene, polyurethane, nitrile-butadiene rubber, carboxylated nitrile-butadiene rubber, polyamide polyvinyl chloride, acrylic, polyvinyl acetate, chlorosulphonated polyethylene rubber, isobutylene-isoprene rubber, or a combination thereof.

15. The polymeric glove of claim 14, wherein the skin contacting coating layer has a thickness from about 0.0005 mm to less than or equal to about 0.01 mm.

16. The polymeric glove of claim 1, formed from an emulsion comprising the polyurethane elastomer.

17. The polymeric glove of claim 1, wherein the polymeric glove has a moisture vapor transmission rate of greater than or equal to about 900 $g/d \cdot m^2$ when determined according to EN 13726-2.

18. The polymeric glove of claim 1, having a normalized breakthrough time of greater than or equal to about 480 minutes in 40% sodium hydroxide.

19. A method to produce a polymeric glove according to claim 1, comprising:

coating a glove former in an aqueous coagulant solution to produce a coagulant coated former;

coating the coagulant coated former with an emulsion comprising a polyurethane elastomer, curing the emulsion comprising the polyurethane elastomer coated on the coagulant coated former to produce a polymer layer thereon; and obtaining the polymeric glove by removing the polymer layer from the former, wherein the polymeric glove comprises the polyurethane elastomer.

20. The method of claim 19, wherein the polyurethane elastomer comprises a biodegradable polyurethane elastomer, and wherein the polymeric glove has a degradation of greater than or equal to about 95% in less than 180 days when determined according to ISO 14855 under a composting condition.

* * * * *